United States Patent [19]

Morishita et al.

[11] Patent Number: 4,707,404

[45] Date of Patent: Nov. 17, 1987

[54] THERMAL TRANSFER RECORDING MATERIAL

[75] Inventors: Sadao Morishita, Ibaraki; Toshihiko Matsushita, Tokyo; Mikiya Sekine, Warabi, all of Japan

[73] Assignee: Mitsubishi Paper Mills, Ltd., Tokyo, Japan

[21] Appl. No.: 717,139

[22] Filed: Mar. 28, 1985

[30] Foreign Application Priority Data

Apr. 3, 1984 [JP] Japan ..... 59-67276
May 21, 1984 [JP] Japan ..... 59-103169

[51] Int. Cl.[4] ..... B41M 5/26

[52] U.S. Cl. ..... 428/335; 428/195; 428/336; 428/488.1; 428/516; 428/519; 428/521; 428/913; 428/914

[58] Field of Search ..... 428/195, 516, 913, 914, 428/335, 336, 484, 488.1, 519, 521; 346/200, 226

[56] References Cited

FOREIGN PATENT DOCUMENTS 0103892 6/1982 Japan ..... 346/226

*Primary Examiner*—Bruce H. Hess
*Attorney, Agent, or Firm*—Cushman, Darby & Cushman

[57] ABSTRACT

A thermal transfer recording material comprising a thin substrate and a thermal transfer ink layer provided on the upper side of the substrate, wherein the thin substrate is a polyethylene film having a density of 0.935 or higher, causes no sticking phenomenon in thermal transfer recording.

The above thermal transfer recording material, when the polyethylene film used therein further has a weight average molecular weight of 200,000 or higher, forms no frost image and causes no sticking of the polyethylene to the surface of a thermal head of a printer.

9 Claims, No Drawings

THERMAL TRANSFER RECORDING MATERIAL

BACKGROUND OF THE INVENTION (1) Field of the Invention

This invention relates to a thermal transfer recording material usable in thermal recording equipments such as thermal printers, thermal facsimiles and the like employing a thermal head.

(2) Description of the Prior Art

Currently, thermal transfer recording materials consisting of a thin substrate and a thermal transfer ink coated on the substrate are in use in thermal printers, thermal facsimiles, etc. to form a clear and durable image on an thermal transfer receiving paper. The mechanism of thermal transfer recording with these recording materials is as follows. That is, on the thermal transfer ink side of a thermal transfer recording material is superimposed an thermal transfer receiving paper. Then, heat is selectively applied to the non-ink side of the recording material with a thermal head synchronously with electric signals, whereby an image is melt- or sublimation-transferred onto the thermal transfer receiving paper. Recording is complete when the thermal transfer recording material and the thermal transfer receiving paper are pulled apart.

The thin substrates used in the above thermal transfer recording materials are required to have such thermal resistance as being able to withstand high temperatures (250° to 350° C.) of thermal heads. It is said that good as such substrates are substrates having no melting point such as a condenser paper, a cellophane paper and the like as well as heat-resistant films having a melting point but capable of withstanding high temperatures of thermal heads such as a polyimide film, a teflon film and the like. Other films such as, for example, a polystyrene film, a polyethylene film, a polypropylene film, a polyvinyl chloride film, a polyvinylidene chloride film, a polyethylene terephthalate film, a polycarbonate film and the like are said to have melting points lower than high temperatures of thermal heads, to melt and stick to thermal heads when printing is made and consequently to cause a so-called "sticking" phenomenon making the movement of thermal heads impossible.

As a countermeasure for such substrates causing the sticking phenomenon, Japanese patent application Kokai (Laid-open) No. 7467/1980 discloses that the side of a substrate coming in contact with a thermal head is provided with a heat-resistant protective film made of one member selected from the group consisting of a silicone resin, an epoxy resin, a melamine resin, a phenolic resin, a fluorine resin, a polyimide resin and a nitrocellulose.

Also, Japanese patent application Kokai (Laid-open) No. 155794/1981 discloses that one side of a plastic film substrate is provided with a sticking prevention layer composed of an inorganic pigment of high lubricity and a thermosetting resin material.

Further, Japanese patent application Kokai (Laid-open) No. 74195/1982 discloses that one side of a plastic film substrate is provided with a sticking prevention layer made of silicon oxide or of a three dimensionally crosslinked product of a polyfunctional (meth)acrylate compound.

However, these countermeasures of providing one side of a substrate with a heat-resistant protective layer or a sticking prevention layer increase production steps of thermal transfer recording materials and incur a higher cost.

SUMMARY OF THE INVENTION

The present inventors have made extensive study to solve the drawbacks of the conventional arts and to produce at a low cost a thermal transfer recording material free from the sticking phenomenon. As a result, it has been found that while polyethylenes have been regarded to cause the sticking phenomenon when used as a substrate for thermal transfer recording materials, a polyethylene having a density of 0.935 or higher hardly causes the sticking phenomenon. Accordingly, the present invention concerns a thermal transfer recording material comprising a thin substrate and a thermal transfer ink layer provided on the upper side of the substrate, wherein the thin substrate is a polyethylene film having a density of 0.935 or higher.

DETAILED DESCRIPTION OF THE INVENTION

In general, there are two types of polyethylene, one type being high density polyethylenes (density: 0.941 to 0.965; melting point: 132° to 135° C.) and the other type being low density polyethylenes (density: 0.910 to 0.940; melting point: 105° to 110° C.). These two types of polyethylenes are being used independently or in mixture in fields of packaging, etc. as inexpensive materials.

As the polyethylene having a density of 0.935 or higher used in the present invention, there can be employed high density polyethylenes as well as blends of a high density polyethylene with a low density polyethylene, if satisfying the above density requirement. Further, there can be employed blends of a polyethylene with a polypropylene. Furthermore, there can be employed copolymers between ethylene and other monomer (e.g. butene) as long as the copolymers are composed essentially of ethylene.

A thermal head is heated, when used, to a temperature as high as 250° to 350° C. (this causes melting of most thermoplastic resin films) and then is rapidly cooled and run. However, in recent high speed thermal printers and thermal facsimiles, the thermal head can not be cooled as low as room temperature by rapid cooling and is run in a still heated state although the temperature of the head during running varies depending upon the type of the equipment wherein the thermal head is used.

The sticking phenomenon between a substrate and a thermal head are influenced by the temperature and time to and in which the thermal head is heated or cooled and also by the melting point and density of the substrate. The sticking phenomenon is further affected delicately by whether the head is one line type or serial type.

The present inventors investigated numerous materials including polyethylenes for use as a substrate. In the investigation, polypropylene films were good next to polyethylene films and other films caused the sticking phenomenon in such a degree that the films can not be used as a practical substrate. Polypropylenes can not be used alone; however, their use in blends with polyethylenes can be considered and it can improve the film formability of polyethylenes. In the present invention, the density of a polyethylene used as a substrate is an important requirement; therefore, as long as the requirement of a density of 0.935 or higher is met, additives such as synthetic resins other than polyethylenes, antioxidants, lubricants, organic and inorganic pigments and the like can safely be added to polyethylenes.

The reason why the polyethylene film according to the present invention causes no sticking phenomenon is presumed to be as follows.

When a thermal head heated to about 300° C. comes in contact with a polyethylene film having a density of 0.935 or higher, the film is melt momentarily but causes no thermal deformation owing to its high density; hence, the thermal head is run in a state where the polyethylene is still molten. Since the polyethylene has low adhesion toward the thermal head and somewhat acts as a lubricant, the polyethylene causes no sticking phenomenon. In contrast, when a polyethylene terephthalate film not subjected to a treatment for imparting heat resistance is used as a substrate of ordinary heat transfer recording materials (usually a polyethylene terephthalate subjected to such treatment is used as such a substrate), the sticking phenomenon occurs presumably because of the following reason. When the polyethylene terephthalate film is melt by a heated thermal head (the melting point of the polyethylene terephthalate is about 250° C.) and then rapidly cooled, the thermal head is cooled to a temperature lower than the melting point and this causes solidification of the molten polyethylene terephthalate and its sticking to the thermal head, whereby poor running of the thermal head arises.

Thus, the sticking phenomenon will not occur if a substrate is still in a molten state at the time of running of a thermal head, namely, at the time of rapid cooling. When the substrate is a polyethylene having a density lower than 0.935, melting and deformation occur concurrently with heating by the thermal head and the deformation hinders running of the thermal head; hence, such a polyethylene can not be used as a practical substrate.

As stated above, the polyethylene substrate used in the present invention requires no treatment for imparting heat resistance and can provide an inexpensive, thermal transfer recording material and therefore has a high industrial value.

In the present invention, it is essential that the polyethylene used as a substrate has a density of 0.935 or higher. Further investigation on the polyethylene from the point of its number average molecular weight has revealed the following. When a polyethylene having a weight average molecular weight smaller than 200,000 is used, a slight head pattern image, namely, a frost image appears at the time of printing by a heated thermal head, and upon observation of the surface of the thermal head by a microscope, sticking of a slight amount of the polyethylene is seen. In contrast, when a polyethylene having a weight average molecular weight of 200,000 or higher is used, the so-called frost image does not appear although the polyethylene at the sites where printing is made gets somewhat transparent, and no polyethylene sticks to the surface of the thermal head. Accordingly, the polyethylene used in the present invention preferably has a weight average molecular weight of 200,000 or higher and particularly preferably of 200,000 to 350,000. Polyethylenes having a density of 0.935 or higher and a Mw of 200,000 or higher are commercially available and they can be made into a film by the inflation method or the T-die method.

The production method of a substrate film has the following effects on production of a thermal transfer recording material.

When a film is produced by the inflation method, the polyethylene crystal in the film is randomly oriented toward both the lengthwise direction and the crosswise direction and the film, when pulled, has a large elongation and a small tensile strength. Therefore, when the thickness of a substrate film (generally ranging from 3 to 30 $\mu$) used in a thermal transfer recording material is 10 to 30 $\mu$, the film can withstand a tension applied when a heat-meltable ink is coated thereon; however, when the thickness of the substrate film is as thin as 3 to 6 H $\mu$, the film has a very low tensile strength and a very large elongation and hence coating of the heat-meltable ink becomes difficult. In contrast, a film produced by the T-die method and strongly oriented toward the lengthwise direction has a large tensile strength and a small elongation. Therefore, in coating of a heat-meltable ink on the film, coating even on a thin film is easy and further, when a coated film is slitted to a narrow width or when a ribbon made from the slitting is used in actual printing by thermal printers, no cutting occurs. Therefore, the polyethylene film used in the present invention is preferably produced by the T-die method.

Next, as the thermal transfer ink layer of the thermal transfer recording material of the present invention, there can be used conventionally known ink layers as they are and the ink is not restricted to any particular one.

That is, the following three types of inks are known as the thermal transfer ink layer.

(1) Heat-meltable inks containing coloring agents (e.g. carbon black, oil black, yellow pigment, magenta pigment, cyan pigment).

(2) Color-developing type thermal transfer inks containing essentially a leuco dye which is colorless at room temperature and a color developer which allows the leuco dye to develop a color when heated.

(3) Sublimation type thermal transfer inks containing essentially a heat-sublimable dye together with a binder.

All of these inks can be used. Among the inks (1), (2) and (3) there is no difference in the degree of sticking between a thermal head and a substrate.

The present invention will be further illustrated by way of the following non-limitative Examples.

EXAMPLE 1

Seven kinds of polyethylene films having a thickness of 10 H $\mu$ and a density ranging from 0.924 to 0.965 were produced by mixing a high density polyethylene having a density of 0.965 and a low density polyethylene having a density of 0.924 (both manufactured by Mitsubishi Chemical Industries, Ltd.) at various mixing ratios. On one side of each film thus produced was coated a hot melt ink containing 12% of carbon balck and having a melting point of 65° C. by the use of a hot melt coater so that the coated ink amount became 3.5 g/m$^2$. On the ink side of the resulting thermal transfer film was superimposed a plain paper (an thermal transfer receiving paper for thermal transfer paper, manufactured by Mitsubishi Paper Mills Ltd., brand name: TTR-T). Printing of a black pattern was made on the non-ink side (back side) of the thermal transfer film by the use of a thermal facsimile tester manufactured by Matsushita Electronic Components Co., Ltd. under conditions of printing pulse widths of 0.8, 1.0 and 2.0 milliseconds and a voltage of 16.0 V.

The evaluation of sticking was made using the runnability of the thermal head (the movability of each substrate). Good runnability was recorded as ; slightly poor runnability was recorded as Δ; and poor runnability was recorded as X. The results are shown in Table 1.

The films having a density of 0.936 or higher gave good runnability. Of the blend films between a high density polyethylene and a low density polyethylene, those having a higher density, for example, of 0.949 or higher gave better runnability.

TABLE 1

| | High density polyethylene: low density polyethylene | Density | Runnability |
|---|---|---|---|
| This invention | 100:0 | 0.965 | 0.8 millisecond . . . |
| | | | 1.0 millisecond . . . |
| | | | 2.0 millisecond . . . |
| This invention | 80:20 | 0.957 | 0.8 millisecond . . . |
| | | | 1.0 millisecond . . . |
| | | | 2.0 millisecond . . . |
| This invention | 60:40 | 0.949 | 0.8 millisecond . . . |
| | | | 1.0 millisecond . . . |
| | | | 2.0 millisecond . . . Δ |
| This invention | 40:60 | 0.940 | 0.8 millisecond . . . |
| | | | 1.0 millisecond . . . Δ |
| | | | 2.0 millisecond . . . X |
| This invention | 30:70 | 0.936 | 0.8 millisecond . . . |
| | | | 1.0 millisecond . . . Δ |
| | | | 2.0 millisecond . . . X |
| Other than this invention | 20:80 | 0.932 | 0.8 millisecond . . . Δ |
| | | | 1.0 millisecond . . . X |
| | | | 2.0 millisecond . . . X |
| Other than this invention | 0:100 | 0.924 | 0.8 millisecond . . . X |
| | | | 1.0 millisecond . . . X |
| | | | 2.0 millisecond . . . X |

EXAMPLE 2

On one side of a high density polyethylene film having a density of 0.960 and a thickness of 10 μ, there was coated the hot melt ink of Example 1 so that the coated ink amount became 3.5 g/m$^2$. Then, the coated film was slitted so as to have a width of 6.0 mm.

The resulting ribbon was loaded into a thermal type electric typewriter EP-20 manufactured by Brother Industries, Ltd., and printing was made on the thermal transfer receiving paper TTR-T of Example 1.

Running of the ribbon was smooth and there was no sticking noise. The transferred letters were sufficiently dense (optical density: 1.20). The standard thermal ribbon used by EP-20 employs as its substrate a polyethylene terephthalate subjected to a treatment for imparting thermal resistance. The above test result proves that the present invention product of lower cost can be safely used as a substrate.

For comparison, the same test was repeated using (1) a commercially available low density polyethylene film having a density of 0.918 and a thickness of 10 μ and (2) a commercially available polyethylene terephthalate film having a thickness of 10 Hμ.

In the case of the low density polyethylene film, the thermal head did not run at all. In the case of the polyethylene terephthalate film, the thermal head, being a serial head, barely ran but the sticking noise was high. Upon inspection of the portions where printing was made, by the use of a magnifying glass, the polyethylene terephthalate film had a frost image due to the unevenness of surface height. Also, the polyethylene terephthalate sticked to the thermal head. Thus, the polyethylene terephthalate film is regarded to be unable to withstand a long time use.

EXAMPLE 3

Using various high density polyethylenes each different in density and number average molecular weight (Mn) as shown in Table 2, 10 different polyethylene films having a thickness of 10 μ were produced by the inflation method.

On one side of each film there was coated, by the use of a hot melt coater, a hot melt ink containing 12% of carbon black and having a melting point of 65° C. so that the coated ink amount became 3.5 g/m$^2$. On the ink side of the resulting thermal transfer film there was superimposed an thermal transfer receiving paper (an thermal transfer receiving paper for thermal transfer paper, manufactured by Mitsubishi Paper Mills Ltd., brand name: TTR-T). They were loaded into a thermal type electric typewriter (Model EP-20) manufactured by Brother Industries, Ltd., and thermal printing was made on the non-ink side (back side) of the thermal transfer film.

Since the above thermal type electric typewriter (EP-20) adopted a serial head, runnability of the thermal head was good; no sticking phenomenon was seen and transferred images were good.

After printing, the ink of each thermal transfer film was wiped off by the use of xylene, and the presence of a frost image at the portions where printing was made as well as the presence of a polyethylene sticked onto the thermal head were observed by the use of a microscope. The results are shown in Table 2.

TABLE 2

| Symbol of polyethylene film | Density | Number average molecular weight (Mw) | Observation: Frost image | Observation: Staining of head |
|---|---|---|---|---|
| 1 | 0.965 | 159,000 | Present | Considerable |
| 2 | 0.953 | 159,000 | Present | Considerable |
| 3 | 0.953 | 173,000 | Present | Slight |
| 4 | 0.960 | 180,000 | Present | Slight |
| 5 | 0.956 | 203,000 | Not present | No staining |
| 6 | 0.953 | 228,000 | Not present | No staining |
| 7 | 0.947 | 252,000 | Not present | No staining |
| 8 | 0.958 | 288,000 | Not present | No staining |
| 9 | 0.935 | 305,000 | Not present | No staining |
| 10 | 0.960 | 307,000 | Not present | No staining |

As is obvious from Table 2, when the density is 0.935 or higher, the presence of a frost image and head staining was not dependent upon the level of the density but rather very much dependent upon the level of the weight average molecular weight. When the number average molecular weight was 200,000 or higher, there appeared neither frost image nor head staining. When the weight average molecular weight was lower than 200,000, there appeared frost images and the thermal head was stained; therefore, in this case, long time use of a thermal head is believed to be difficult.

Further, for comparison, the same test was repeated using a low density polyethylene film having a density of 0.925, a weight average molecular weight (Mw) of 210,000 and a thickness of 10 μ. However, the film sticked to the thermal head and running of the thermal head was impossible.

EXAMPLE 4

A polyethylene having a density of 0.953 and a number average molecular weight (Mw) of 228,000 was subjected to quenching-heating stretching by the T-die method to obtain a film of 6 $\mu$ in thickness.

On one side of this film there was coated the thermal transfer ink of Example 3. The coated film was passed through a ribbon slitter to produce a ribbon of 6 mm in width. Even when the tension at the time of slitting was made slightly stronger, the stretching of the ribbon film was small and there was no cutting. Using this ribbon film, there was prepared a film cassette fitting the thermal type electric typewriter (EP-20) of Example 3, and printing was made. There was no problem in runnability of the head (actually, runnability of the ribbon film) and, after printing, the film had no frost image and the head had no sticks.

For comparison, using the same polyethylene, a film of 6 $\mu$ was produced by the inflation method. Then, coating of the thermal transfer ink and subsequent slitting into a width of 6 mm by the ribbon slitter were made. Coating of the thermal transfer ink was conducted for a film width of 500 mm; therefore, coating was possible with only slight stretching of the film. Slitting was conducted for widths of 6 mm and 210 mm. In 6 mm slitting, cutting due to stretching of the ribbon film occurred many times and winding with a tension being applied was impossible. In 210 mm slitting, although the slitting tension was low, there was no cutting and winding was possible, and the ribbon obtained could be put into practical use as in Example 3.

From the above, it was ascertained that in production of thin and narrow ribbons, the inflation method is not suitable because of frequent cutting and bad operatability and the T-die method is far superior.

What is claimed is:

1. A thermal transfer recording material comprising a thin substrate and a thermal transfer ink layer provided on the upper side of the substrate, wherein the thin substrate is a polyethylene film having a density of 0.935 or higher.

2. A thermal transfer recording material according to claim 1, wherein the polyethylene film has a weight average molecular weight of 200,000 or higher.

3. A thermal transfer recording material according to claim 1 or 2, wherein the polyethylene film has a thickness of 3 to 30 $\mu$.

4. A thermal transfer recording material according to claim 2, wherein the polyethylene film has a weight average molecular weight of 200,000 to 350,000.

5. A thermal transfer recording material according to claim 2 wherein the polyethylene film has a thickness of 3 to 30 $\mu$.

6. A thermal transfer recording material according to claim 1, wherein the polyethylene film is produced by the T-die method.

7. A thermal transfer recording material according to claim 1, wherein the polyethylene film is selected from the group consisting of high density polyethylenes and blends between a high density polyethylene and a low density polyethylene.

8. A thermal transfer recording material comprising a thin substrate and a thermal transfer ink layer provided on the upper side of the substrate, wherein the thin substrate is a film of blends between a polyethylene and a polypropylene, said film having a density of 0.935 or higher.

9. A thermal transfer recording material comprising a thin substrate and a thermal transfer ink layer provided on the upper side of the substrate, wherein the thin substrate is a film of a copolymer between ethylene and butene, composed essentially of ethylene, said film having a density of 0.935 or higher.

* * * * *